US009057989B2

(12) United States Patent
Montag et al.

(10) Patent No.: US 9,057,989 B2
(45) Date of Patent: Jun. 16, 2015

(54) METHOD AND DEVICE FOR DRYING A FIRST SIDE TONER IMAGE BEFORE APPLYING AN OPPOSITE SIDE SECOND TONER IMAGE

(71) Applicants: Thomas Montag, Unterhaching (DE); Alexander Breitenbach, Graefelfing (DE); Gunnar Raschke, Munich (DE); Andrae le Coutre, Markt Schwaben (DE); Roland Bilke, Aschheim (DE)

(72) Inventors: Thomas Montag, Unterhaching (DE); Alexander Breitenbach, Graefelfing (DE); Gunnar Raschke, Munich (DE); Andrae le Coutre, Markt Schwaben (DE); Roland Bilke, Aschheim (DE)

(73) Assignee: Océ Printing Systems GmbH, Poing (DE)

( * ) Notice: Subject to any disclaimer, the term of this patent is extended or adjusted under 35 U.S.C. 154(b) by 105 days.

(21) Appl. No.: 13/864,613

(22) Filed: Apr. 17, 2013

(65) Prior Publication Data

US 2013/0272749 A1 Oct. 17, 2013

(30) Foreign Application Priority Data

Apr. 17, 2012 (DE) ..... 10 2012 103 343

(51) Int. Cl.

| | |
|---|---|
| ***G03G 15/10*** | (2006.01) |
| ***G03G 15/22*** | (2006.01) |
| ***G03G 15/23*** | (2006.01) |
| ***G03G 15/11*** | (2006.01) |

(52) U.S. Cl.

CPC ..... *G03G 15/104* (2013.01); *G03G 15/238* (2013.01); *G03G 15/11* (2013.01); *G03G 15/231* (2013.01)

(58) Field of Classification Search

CPC ..... G03G 15/11; G03G 15/238; G03G 2215/00586; G03G 2215/0658; G03G 13/11; G03G 15/231; G03G 15/104

USPC ..... 399/249, 251, 306, 309

See application file for complete search history.

(56) References Cited

U.S. PATENT DOCUMENTS

| | | | | |
|---|---|---|---|---|
| 5,424,813 | A | 6/1995 | Schlueter | |
| 5,740,510 | A * | 4/1998 | Van den Bogaert et al. | 399/298 |
| 5,765,081 | A | 6/1998 | Bogaert | |
| 5,809,388 | A * | 9/1998 | Inada et al. | 399/320 |
| 5,835,836 | A * | 11/1998 | Hirao | 399/336 |
| 6,032,015 | A * | 2/2000 | Umeda et al. | 399/306 |
| 6,535,711 | B2 * | 3/2003 | Rohde et al. | 399/306 |
| 7,801,472 | B2 | 9/2010 | Kreiter | |

(Continued)

FOREIGN PATENT DOCUMENTS

| | | |
|---|---|---|
| DE | 102005023462 | 11/2006 |
| DE | 102008048256 | 4/2010 |

(Continued)

*Primary Examiner* — Robert Beatty

(74) *Attorney, Agent, or Firm* — Schiff Hardin LLP

(57) ABSTRACT

In a method or system to operate a digital printer for double-side printing to a recording medium with toner particles applied with a liquid developer, the digital printer prints first and second sides of the recording medium in succession. Electrophoretic mobility of toner particles of a first toner image on the first side is reduced after application of said first toner image and before application of the second toner image on the second side of the recording medium. The electrophoretic mobility is reduced by drying the first toner image along a drying route in an airflow generated by a blower such that carrier fluid is thus removed from the first toner image. After the application of the second toner image on the second side of the recording medium, both the first and second toner images are simultaneously fixed.

15 Claims, 4 Drawing Sheets

(56) References Cited

U.S. PATENT DOCUMENTS

| | | | | |
|---|---|---|---|---|
| 8,452,219 | B2 * | 5/2013 | Izawa et al. | 399/336 |
| 8,737,885 | B1 * | 5/2014 | Berg | 399/249 |
| 2002/0106220 | A1 | 8/2002 | Nakashima et al. | |
| 2011/0026991 | A1 | 2/2011 | Izawa et al. | |
| 2011/0150534 | A1 | 6/2011 | Kopp | |
| 2011/0249990 | A1 | 10/2011 | Izawa et al. | |
| 2012/0020697 | A1 * | 1/2012 | Stelter et al. | 399/94 |

FOREIGN PATENT DOCUMENTS

| | | | |
|---|---|---|---|
| DE | 102009060334 | | 6/2011 |
| DE | 102010015985 | | 9/2011 |
| JP | 2002278323 | A * | 9/2002 |
| JP | 2009163064 | A * | 7/2009 |

* cited by examiner

METHOD AND DEVICE FOR DRYING A FIRST SIDE TONER IMAGE BEFORE APPLYING AN OPPOSITE SIDE SECOND TONER IMAGE

BACKGROUND

The disclosure concerns a method to operate a digital printer for double-sided printing of a recording medium with toner particles that are applied with the aid of a liquid developer, in particular a high-speed printer to print to web-shaped or sheet-shaped recording media.

In such digital printers, a latent charge image of a charge image carrier is inked by means of electrophoresis with the aid of a liquid developer. The toner image that is created in such a manner is transferred indirectly (via a transfer element) or directly to the recording medium. The liquid developer has toner particles and cleaning fluid in a desired ratio. Mineral oil is advantageously used as a cleaning fluid. In order to provide the toner particles with an electrostatic charge, charge control substances are added to the liquid developer. Further additives are additionally added, for example, in order to achieve the desired viscosity or a desired drying behavior of the liquid developer.

Such digital printers have been known for a long time, for example from DE 10 2010 015 985 A1, DE 10 2008 048 256 A1, US 2011/0249990 A1, US 005 424 813 A or DE 10 2009 060 334 A1.

A method for operating with liquid developer is known from US 2002/0106220 A1, in which a first toner image is fixed directly on the recording medium upon application. A separate fixing process is required for each page of the recording medium that is to be printed. Moreover, this fixing negatively affects the quality of the surface of the second side of the recording medium as a result of the drying, shrinking, fold formation etc. The print image on the second side is therefore negatively affected in terms of quality.

A method with which a recording medium is printed on both sides by two opposite print groups is known from the document DE 10 2005 023 462 A1. The polarity of the charge of the toner particles in one of the two print groups is hereby changed before the application of the toner particles on the recording medium, whereby a negative effect on the quality of the print image can be created.

SUMMARY

It is an object of the invention to specify a method and a digital printer operating with a liquid developer, in which a qualitatively high-grade print image is generated on both sides in the two-sided printing of a recording medium.

In a method or system to operate a digital printer for double-side printing to a recording medium with toner particles applied with a liquid developer, the digital printer prints first and second sides of the recording medium in succession. Electrophoretic mobility of toner particles of a first toner image on the first side is reduced after application of said first toner image and before application of the second toner image on the second side of the recording medium. The electrophoretic mobility is reduced by drying the first toner image along a drying route in an airflow generated by a blower such that carrier fluid is thus removed from the first toner image. After the application of the second toner image on the second side of the recording medium, both the first and second toner images are simultaneously fixed.

DESCRIPTION OF PREFERRED EXEMPLARY EMBODIMENTS

Figure 1:
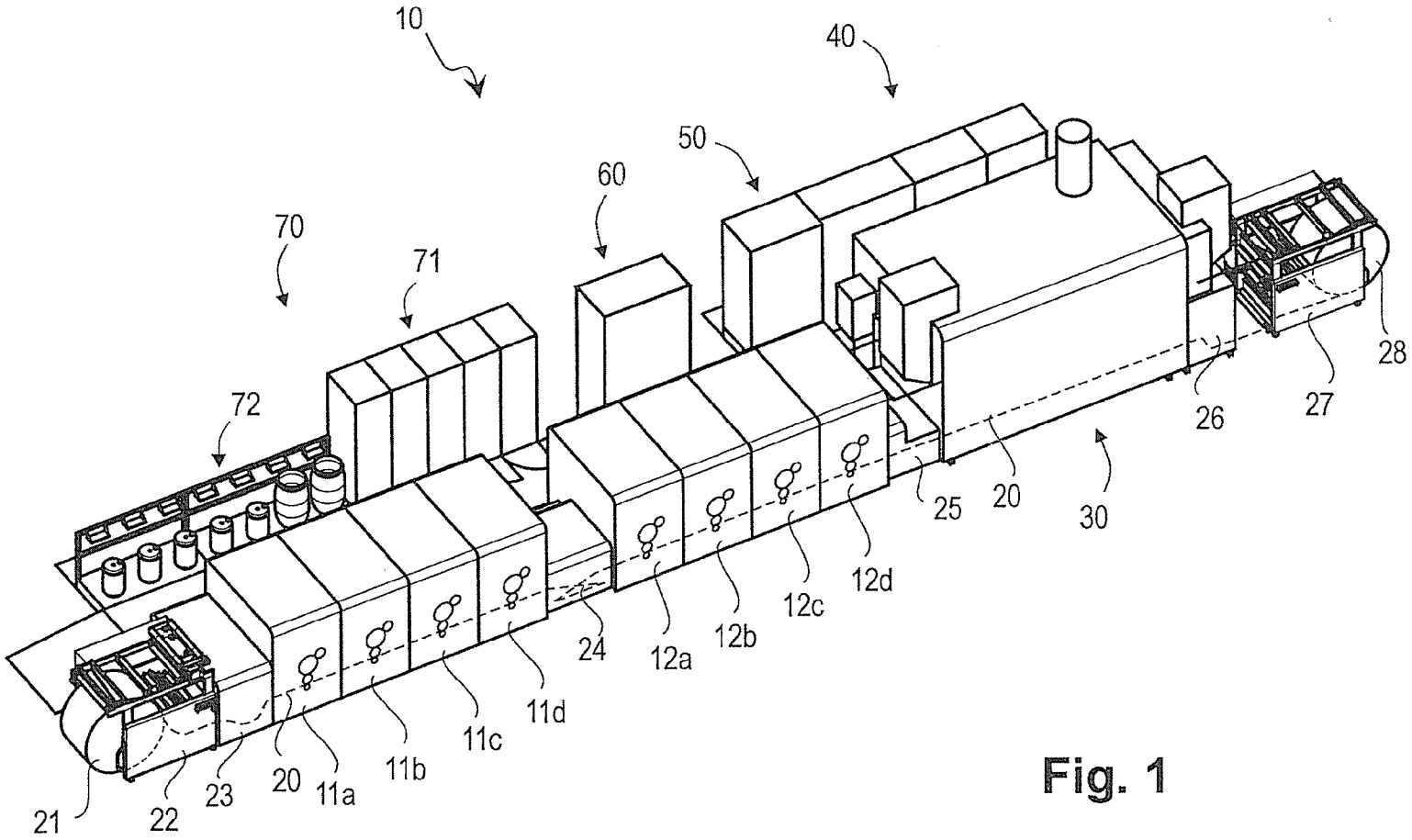
FIG. 1 is a view of a digital printer given an example configuration of the digital printer.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

According to an exemplary embodiment, the first toner image is applied to the first side of the recording medium by means of an electrophoretic method, wherein the first toner image includes toner particles that have an electrical charge. The toner particles are accordingly electrophoretically mobile in the still-wet toner image applied on the first side, and can migrate in an electrical field. If no countermeasures are taken, given an electrophoretic application of the second toner image on the second side of the recording medium the toner particles of the first toner image can execute wandering motions in the electrical field that is required for this, which wandering motions can negatively affect the print image on the first side. Therefore, according to an exemplary embodiment the electrophoretic mobility of the toner particles of the first toner image is reduced. This leads to the situation that the migration capability of the toner particles is limited, and the still wet toner image on the first side remains unchanged in terms of its print quality, even if this toner image is exposed to an electrical field upon electrophoretic application of the second toner image on the second side (double-sided printing). Only after the application of the second toner image on the second side of the recording medium are both toner images simultaneously fixed. The toner particles on the two respective sides are hereby fused and permanently bond with the recording medium.

According to one exemplary embodiment, the first side of the recording medium is charged with ions from an ion source before the application of the second toner image on its second side. The first toner image includes toner particles that have an electrical charge. This charge makes it possible for the toner particles to migrate in the electrical field, which is used in the electrophoretic application of the respective toner image. The ions have an electrical charge that is opposite the charge of the toner particles.

The electrophoretic mobility of the toner particles is dependent on their electrical charge. A higher charge produces a higher electrophoretic mobility given otherwise identical framework conditions. The different electrical charges are at least partially neutralized or have been electrical shielded via the contact of the ions with the toner particles. The electrophoretic mobility of the toner particles in the still present carrier fluid is thereby reduced. This has the result that the toner particles in the first toner image are not affected by the electrical field with whose help the second toner image is applied on the second side of the recording medium. The quality of the first toner image is thus not negatively affected.

The surface quality of the recording medium on the second side that is subsequently to be printed is not modified or is barely modified upon being charged with ions, and essentially has the same surface properties as the first side before printing. After a joint fixing of both toner images, a qualitatively high-grade, fixed print image is therefore respectively created on both sides of the recording medium.

The polarity of the ions is always opposite the polarity of the electrical charge of the toner particles. For example, if the toner particles have a positive charge due to their interaction with the charge control substances, negatively charged ions are thus used to charge the surface of the recording medium. However, if the toner particles have a negative charge, the surface is charged with positively charged ions.

In a preferred exemplary embodiment of the method, the first side is charged with the ions such that the polarity of the electrical charge of the toner particles of the first toner image is neutralized or so that their polarity changes. Upon application of the second toner image, the electrically charged toner particles thereby move in the electrical field in the direction of the recording medium, and not in the direction of a counter-pressure roller. This particularly effectively prevents toner particles from depositing on the counter-pressure roller, whereby the quality of the print image on the first side remains unchanged.

In a further exemplary embodiment of the invention, the method comprises a drying route that is traversed by the recording medium after the application of the first toner image and before application of the second toner image. An air flow generated by a blower is directed along on the first side along this drying route. Evaporated portions of the carrier fluid are removed from the recording medium by this air flow, wherein the recording medium dries. A non-polar fluid with highly specific electrical resistance is advantageously used as a carrier fluid. In particular, aliphatic hydrocarbons are suitable that are offered under the trade name Isopar® by the ExxonMobile Chemical corporation or Shellsol® by the Shell Chemicals corporation, for example. The electrophoretic mobility of the toner particles of the first toner image decreases due to the reduced proportion of carrier fluid. The remaining residue of carrier fluid is no longer sufficient in order to enable the toner particles to migrate in the electrical field.

In one development, the air flow is heated by a heating device to a predetermined temperature. Heat accelerates the evaporation of the carrier fluid, whereby the electrophoretic mobility of the toner particles is rapidly reduced. On the one hand, a higher temperature produces a faster evaporation of the carrier fluid; on the other hand, it also produces a drying of the recording medium, which entails the danger of shrinkage, creasing and/or alteration of the printing substrate surface. In tests it has turned out that an optimum is achieved at air flow temperatures in the range from 40° C. to 50° C. The temperature is to be selected so that it lies below the glass temperature of the toner particles because a fusing of the toner particles is to be avoided and should only take place in a fixing process after the application of the second toner image. The suitable temperature value is also dependent on the type of recording medium that is used.

In a further embodiment, the air flow before contact with the recording medium is directed by a humidifier via which the toner image of the first side is moistened. The electrophoretic mobility of the toner particles is reduced by this measure in that the electrical charge of the toner particles is affected. The moistening is to be adjusted depending on the recording medium that is used.

In the humidifier, the relative humidity of the air flow is advantageously adjusted such that a relative humidity on the second side of the recording medium is adjusted that significantly coincides with the relative moisture of the first side before the application of the first toner image. Essentially the same conditions are thus present upon printing to each side of the recording medium, which enables a qualitatively identical high-grade print image on the first side and the second side.

According to a further exemplary embodiment of the invention, the relative moisture of the recording medium on the first side is determined by means of a sensor before the application of the toner image, and the relative humidity of the air flow is adjusted depending on this measurement value. A higher temperature in the air flow can thereby be set that, although it accelerates the evaporation of the carrier fluid, also entails the danger of drying out the recording medium, which can disadvantageously affect the quality of the print image. However, if a sufficiently higher water proportion is present in the air flow, the drying out of the recording medium is reduced so far that qualitatively high-grade print images can be generated.

The aforementioned measures to reduce the electrophoretic mobility of the toner particles of the first toner image applied on the first side (namely charging with ions, drying and moistening) can respectively be applied individually or in combination with one another. An optimum can be achieved when the cited measures are used in matching order and with matching effective force on the electrophoretic mobility. This can respectively take place depending on the manner and type of recording medium that is used.

In a particularly preferred exemplary embodiment of the invention, the drying of the first toner image is implemented before its charging with ions. The drying reduces the amount of carrier fluid of the first toner image surrounding the toner particles. The toner particles thereby become more accessible to ions, such that their charge can more effectively be neutralized by the ions.

According to a further embodiment of the invention, a digital printer is specified for execution of the method. The technical advantages that can be achieved with the digital printer coincide with those described in the method.

Exemplary embodiments are explained in detail in the following using the schematic drawings.

According to FIG. 1, a digital printer 10 to print to a recording medium 20 has one or more print groups 11*a*-11*d* and 12*a*-12*d* that print a toner image (print image 20'; see FIG. 2) to the recording medium 20. As a recording medium 20, as shown a web-shaped recording medium 20 is unrolled from a roll 21 with the aid of an unroller 22 and is supplied to the first print group 11*a*. In a fixing unit 30, the print image 20' is fixed on the recording medium 20. The recording medium 20 can subsequently be rolled up on a roll 28 with the aid of a take-up stand 27. Such a configuration is also designated as a roll-to-roll printer.

In the preferred configuration shown in FIG. 1, the web-shaped recording medium 20 is printed in full color with four print groups 11*a* through 11*d* on the front side and with four print groups 12*a* through 12*d* on the back side (what is known as a 4/4 configuration). For this, the recording medium 20 is unwound by the unroller 22 from the roll 21 and supplied via an optional conditioning group 23 to the first print group 11*a*. In the conditioning group 23, the recording medium 20 can be pre-treated or coated with a suitable substance. Wax or chemically equivalent substances can advantageously be used as a coating substance (also designated as a primer).

This substance can be applied over the entire surface of the recording medium 20—or only to the points of the recording medium 20 that are to be printed later—in order to prepare the recording medium 20 for the printing and/or to affect the absorption response of the recording medium 20 upon application of the print image 20'. It is therefore prevented that the later applied toner particles or the cleaning fluid do not penetrate too significantly into the recording medium 20, but rather essentially remain on the surface (color quality and image quality are thereby improved).

The recording medium 20 is subsequently initially supplied in order to the first print groups 11*a* through 11*d* in which only the front side is printed. Each print group 11*a*-11*d* typically prints the recording medium 20 in a different color, or also with different toner material (for example MICR toner, which can be read electromagnetically).

After the printing of the front side, the recording medium 20 is turned in a turning unit 24 and supplied to the remaining print groups 12*a*-12*d* to print the back side. A drying route 212 (shown in FIG. 3) is arranged in the region of the turning unit 24, via which the recording medium 20 is prepared for the printing of the back side. It is thus prevented that the front side print image is mechanically damaged upon additional transport through the subsequent print groups.

In order to achieve a full-color printing, at least four colors (and therefore at least four print groups 11, 12) are required, namely the primary colors YMCK (yellow, magenta, cyan and black), for example. Additional print groups 11, 12 with special colors (for example customer-specific colors or additional primary colors in order to expand the printable colors space) can also be used.

Arranged after the print group 12*d* is a registration unit 25 via which registration marks that are printed on the recording medium 20 independently of the print image 20' (in particular outside of the print image 20') are evaluated. The transverse and longitudinal register (the primary color points that form a color point should be arranged over one another or spatially very closely adjacent to one another; this is also designated as color register or four-color register) and the register (front side and back side must spatially coincide precisely) can thereby be adjusted so a qualitatively good print image 20' is achieved.

Arranged after the registration unit 25 is the fixing unit 30 via which the print image 20' is fixed on the recording medium 20. In electrophoretic digital printers, a thermo-dryer is advantageously used as a fixing unit 30 that largely evaporates the cleaning fluid so that only the toner particles remain on the recording medium 20. This occurs under the effect of heat. The toner particles on the recording medium 20 can thereby also be fused insofar as they have a material (resin, for example) that can be fused as the result of a heating effect.

Arranged after the fixing unit 30 is a feed group 26 that pulls the recording medium 20 through all print groups 11*a*-12*d* and the fixing unit 30 without an additional drive being arranged in this region. The danger that the print image 20' that has not yet been fixed could be smeared would exist due to a friction feed for the recording medium 20.

The feed group supplies the recording medium 20 to the take-up stand 27 that rolls up the printed recording medium 20.

Centrally arranged in the print groups 11, 12 and the fixing unit 30 are all supply devices for the digital printer 10, such as climate control modules 40, power supply 50, controller 60, modules for fluid management 70, fluid control unit 71 and storage reservoir 72 of the different fluids. In particular, pure carrier fluid, highly concentrated liquid developer (high proportion of toner particles in relation to the cleaning fluid) and serum (liquid developer plus charge control substances) are required as liquids in order to supply the digital printer 10, as well as waste reservoirs for liquids to be disposed of or containers for cleaning fluid.

The digital printer 10 is of modular design with its structurally identical print groups 11, 12. The print groups 11, 12 do not differ mechanically, but rather only in the liquid developers that are to be used in them (toner color or toner type).

Figure 2:
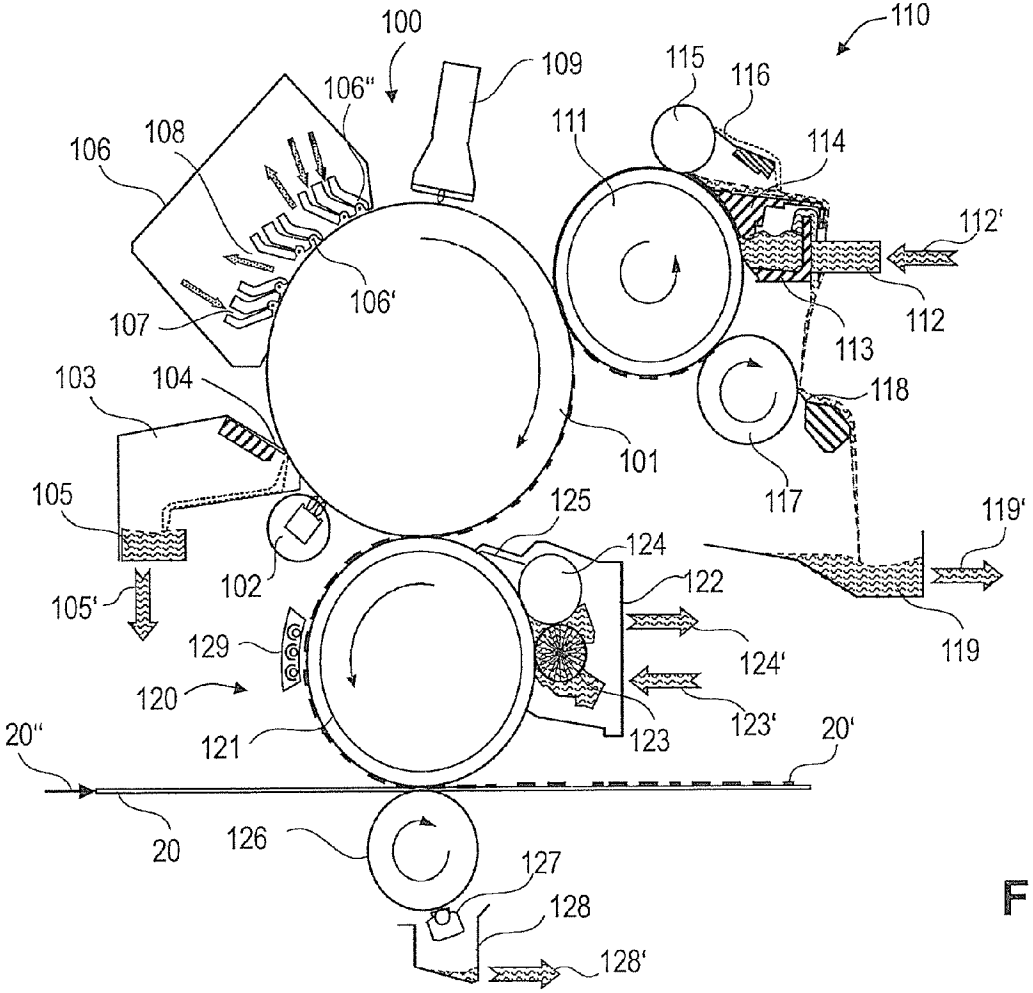
FIG. 2 is a schematic design of a print group of the digital printer according to FIG. 1.

The design of a print group 11, 12 in principle is shown in FIG. 2. Such a print group is based on the electrophotographic principle, in which a photoelectric image carrier is inked with charged toner particles with the aid of a liquid developer and the image that is created in such a manner is transferred to the recording medium 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). Here the photoconductor is designed as a roller (photoelectric roller 101) and has a hard surface. The photoelectric roller 101 rotates past the various elements to generate a print image 20' (rotation in the direction of the arrow).

The photoconductor is initially cleaned of all contaminants. For this, an erasing light 102 is present that erases charges that still remain on the surface of the photoconductor. The erasing light 102 can be coordinated (locally adjusted) in order to achieve a homogeneous light distribution. The surface can therefore be pre-treated uniformly.

After the erasing light 102, a cleaning device 103 mechanically cleans off the photoconductor in order to remove toner particles (possibly dirt particles) and remaining cleaning fluid that are possibly still present on the surface of the photoconductor. The cleaned-off cleaning fluid is supplied to a collection reservoir 105. The collected cleaning fluid and toner particles are prepared (possibly filtered) and supplied depending on the color to a corresponding liquid color storage, i.e. to one of the storage reservoirs 72 (see arrow 105').

The cleaning device 103 advantageously has a blade 104 that rests on the generated surface of the photoconductor roller 101 at an acute angle (for instance 10° to 80° relative to the outlet surface) in order to mechanically clean off the surface. The blade 104 can move back and forth transverse to the rotation direction of the photoconductor roller 101 in order to clean the generated surface with as little wear as possible on the entire axial length.

The photoconductor is subsequently charged by a charging device 106 to a predetermined electrostatic potential. Multiple corotrons (in particular glass shell corotrons) are advantageously present for this. The corotrons comprise at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 107 for ventilation and exhaust channel 108 to exhaust) between the shields (see also air flow arrows in FIG. 2). The supplied air is then ionized uniformly at the wire 106'. A homogeneous, uniform charge of the adjacent surface of the photoconductor is thereby achieved. The uniform charge is further improved with dry and heated air. Air is discharged via the exhaust channels 108. Ozone that is possibly created can likewise be drawn off via the exhaust channels 108.

The corotrons can be cascaded, meaning that two or more wires 106' are then present per shield 106" given the same shield voltage. The current that flows across the shield 106" can be adjusted, and the charge of the photoconductor can thereby be controlled. The corotrons can be fed with different amounts of current in order to achieve a uniform and sufficiently high charge at the photoconductor.

Arranged after the charging device 106 is a character generator 109 that discharges the photoconductor per pixel via optical radiation, depending on the desired print image 20'. A latent image is thereby created that is inked later with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical image points on the photoconductor determine the resolution of the print image 20' (typical resolution is 600×600 dpi). The LEDs can be controlled individually in terms of time and with regard to their radiation power. Multilevel methods can thus be applied to generate raster points (comprising multiple image points or pixels), or image points are time-delayed in order to implement corrections electro-optically, for example given uncorrected color registration or register.

The character generator 109 has a control logic that must be cooled, due to the plurality of LEDs and their radiation power. The character generator 109 is advantageously liquid-cooled. The LEDs can be activated per group (multiple LEDs assembled into a group) or separately from one another.

The latent image generated by the character generator 109 is inked with toner particles by the developer station 110. For this the developer station 110 has a rotating developer roller 111 that directs a layer of liquid developer towards the photoconductor (the functionality of the developer station 110 is explained in detail further below). Since the surface of the photoconductor roller 101 is relatively hard, the surface of the developer roller 111 is relatively soft, and the two are pressed against one another; a thin, high nip (a gap between the rollers) is created in which the charged toner particles migrate electrophoretically from the developer roller 111 to the photoconductor at the image points due to an electrical field. In the non-image points, no toner transfers to the photoconductor. The nip filled with liquid developer has a height (thickness of the gap) that is dependent on the mutual pressure of the two rollers 101, 111 and the viscosity of the liquid developer. The height of the nip typically lies in the range greater than approximately 2 μm to approximately 20 μm (the values can also change depending on the viscosity of the liquid developer). The length of the nip amounts to a few millimeters, for instance.

The inked image rotates with the photoconductor roller 111 up to a first transfer point at which the inked image is essentially transferred completely to a transfer roller 121. The transfer roller 121 moves to the first transfer point (nip between photoconductor roller 101 and transfer roller 121) in the same direction, and advantageously with identical velocity as the photoconductor roller 101. After the transfer of the print image 20' to the transfer roller 121, the print image 20' (toner particles) can optionally be recharged or charged by means of a charging unit 129 (a corotron, for example) in order to be able to subsequently transfer the toner particles better to the recording medium 20.

The recording medium 20 runs through between the transfer roller 121 and a counter-pressure roller 126 in the transport direction 20". The contact region (nip) represents a second transfer point in which the toner image is transferred to the recording medium 20. In the second transfer region, the transfer roller 121 moves in the same direction as the recording medium 20. The counter-pressure roller 126 rotates in this direction in the region of the nip. The velocities of the transfer roller 121, the counter-pressure roller 126 and the recording medium 20 are matched to one another at the transfer point and are advantageously identical, such that the print image 20' is not smeared. At the second transfer point, the print image 20' is transferred electrophoretically to the recording medium 20 due to an electrical field between the transfer roller 121 and the counter-pressure roller 126. Moreover, the counter-pressure roller 126 presses with high mechanical force against the relatively soft transfer roller 121, whereby the toner particles remain stuck to the recording medium 20 due to the adhesion.

Since the surface of the transfer roller 121 is relatively soft and the surface of the counter-pressure roller 126 is relatively hard, a nip is created upon unrolling, in which nip the toner transfer occurs. Irregularities in the thickness of the recording medium 20 can therefore be equalized, such that the recording medium 20 can be printed without gaps. Such a nip is also well suited to print thicker or more uneven recording media 20, for example as is the case in the printing of packaging.

The print image 20' should in fact transfer to the recording medium 20; nevertheless, a few toner particles can nevertheless undesirably remain on the transfer roller 121. A portion of the cleaning fluid always remains on the transfer roller 121 as a result of the wetting. The toner particles that are possibly still present should be nearly entirely removed by a cleaning unit 122 following the second transport point. The cleaning fluid that is still located on the transfer roller 121 can also be completely removed from the transfer roller 121, or be removed up to a predetermined layer thickness, so that identical conditions prevail after the cleaning unit 122 and before the first transfer point from the photoconductor roller 101 to the transfer roller 121 due to a clean surface or a defined layer thickness with liquid developer on the surface of the transfer roller 121.

This cleaning unit 122 is advantageously designed as a wet chamber with a cleaning brush 123 and a cleaning roller 123. In the region of the brush 123, cleaning fluid (for example carrier fluid or a separate cleaning fluid are used) is supplied via a cleaning fluid supply 123'. The cleaning brush 123 rotates in the cleaning fluid and thereby "brushes" the surface of the transfer roller 121. The toner adhering to the surface is thereby loosened.

The cleaning roller 124 lies at an electrical point in time that is opposite the charge of the toner particles. As a result of this, the electrically charged toner is removed from the transfer roller 121 by the cleaning roller 124. Since the cleaning roller 123 touches the transfer roller 121, it also removes cleaning fluid remaining on the transfer roller 121, together with the supplied cleaning fluid. A conditioning element 125 is arranged at the outlet from the wet chamber. As shown, a retention plate can be used as a conditioning element 125, which retention plate is arranged at an obtuse angle (for instance between 100° and 170° between plate and outlet surface) relative to the transfer roller 121, whereby residues of fluid on the surface of the roller are nearly completely retained in the wet chamber and are supplied to the cleaning roller 124 for removal via a cleaning fluid discharge 124' to a cleaning fluid reservoir (in the storage reservoirs 72) that is not shown.

Instead of the retention plate, a dosing unit (not shown) can also be arranged there that, for example, has one or more dosing rollers. The dosing rollers have a predetermined clearance from the transfer roller 121 and receive so much cleaning fluid that a predetermined layer thickness arises after the dosing rollers as a result of the squeezing. The surface of the transfer roller 121 is then not completely cleaned off; cleaning fluid of a predetermined layer thickness remains over the entire surface. Removed cleaning fluid is directed via the cleaning roller 124 back to the cleaning fluid storage reservoir.

The cleaning roller 124 itself is mechanically kept clean via a blade (not shown). Fluid that is cleaned off—including toner particles—is captured for all colors via a central collection reservoir, cleaned and supplied to the central cleaning fluid storage reservoir for reuse.

The counter-pressure roller 126 is likewise cleaned via a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and provided again to the printing process (possibly cleaned) via a fluid discharge 128'.

In the print groups 11 that print the front side of the recording medium 20, the counter-pressure roller 126 presses against the unprinted side (and thus the side that is still dry) of the recording medium 20.

Nevertheless, dust/paper particles or other dirt particles can already be located on the dry side that are then removed from the counter-pressure roller 126. For this, the counter-pressure roller 126 should be wider than the recording medium 20. As a result of this, contaminants can also be cleaned off well outside of the printing region.

In the print groups 12 that print to the back side of the recording medium 20, the counter-pressure roller 126 presses directly on the print image 20' of the front side that has not yet been fixed. So that the print image 20' is not removed by the counter-pressure roller 126, the surface of the counter-pressure roller 126 must have anti-adhesion properties with regard to toner particles and also with regard to the cleaning fluid on the recording medium 20.

The developer station 110 inks the latent print image 20' with a predetermined toner. For this, the developer roller 111 directs toner particles towards the photoconductor. In order to ink the developer roller 111 itself with a layer over its entire area, liquid developer is initially supplied to a storage chamber from a mixing container (within the fluid control unit 71; not shown) via a fluid feed 112' with a predetermined concentration. Given a surplus, the liquid developer is supplied from this reservoir chamber 112 to a pre-chamber 113 upon overflow (a type of pan that is open at the top). An electrode segment 114 that forms a gap between itself and the developer roller 111 is arranged towards said developer roller 111.

The developer roller 111 rotates through the pre-chamber 113 (open at the top) and thereby carries liquid developer along into the gap. Excess liquid developer runs from the pre-chamber 113 back to the reservoir chamber 112.

Due to the electrical field formed by the electrical point in time between the electrode segment 114 and the developer roller 11, in the gap the liquid developer is divided into two regions, and in fact into a layer region in proximity to the developer roller 111 in which the toner particles concentrate (concentrated liquid developer) and a second region in proximity to the electrode segment 114 that is low in toner particles (very low concentration of liquid developer.

The layer of liquid developer is subsequently transported further to a dosing roller 115. The dosing roller 115 squeezes the upper layer of the liquid developer so that a defined layer thickness of liquid developer of approximately 5 μm subsequently remains on the developer roller 111. Since the toner particles are significantly located near the surface of the developer roller 111 in the cleaning fluid, the outlying cleaning fluid is significantly squeezed out or retained and ultimately is supplied to a collection container 119, but not to the storage container 112.

As a result of this, predominantly highly concentrated liquid developer is conveyed through the nip between dosing roller 115 and developer roller 111. A uniformly thick layer of liquid developer with approximately 40 percent cleaning fluid by mass thus arises after the dosing roller 115 (the mass ratios can also fluctuate more or less depending on the printing process requirements). This uniform layer of liquid developer is transported into the nip between the developer roller 111 and the photoconductor roller 101. There the image points of the latent image are then electrophoretically inked with toner particles, while no toner passes to the photoconductor in the region of the non-image points. Sufficient carrier fluid is absolutely necessary for electrophoresis. The fluid film splits approximately in the middle after the nip as a result of wetting, such that one part of the layer remains adhered to the surface of the photoconductor roller 101 and the other part (essentially carrier fluid for image points and essentially toner particles and carrier fluid for non-image points) remains on the developer roller 111.

So that the developer roller 111 can be coated again with liquid developer under the same conditions and uniformly, toner particles (these essentially represent the negative, untransferred print image) will remain, and liquid developer with be electrostatically and mechanically removed by a cleaning roller 117. The cleaning roller 117 itself is cleaned by a blade 118. The cleaned-off liquid developer is supplied to the collection container 119 for re-use, to which the liquid developer cleaned off of the dosing roller 115 (by means of a blade 116, for example) and the liquid developer cleaned off of the photoconductor roller 101 by means of the blade 104 are also supplied.

The liquid developer collected in the collection container 119 is supplied to the mixing container via the liquid discharge 119'. Fresh liquid developer and clean carrier fluid are also supplied as needed to the mixing container. Sufficient liquid in a desired concentration (predetermined ratio of toner particles to carrier fluid) must always be present in the mixing container. The concentration in the mixing container is continuously measured and regulated accordingly depending on the supply of the amount of cleaned-off liquid developer and its concentration, as well as of the amount and concentration of fresh liquid developer or carrier fluid.

For this, the most highly concentrated liquid developer, pure carrier fluid, serum (carrier fluid and charge control substances in order to control the charge of the toner particles) and cleaned-off liquid developer can be separately supplied to this mixing container from the corresponding storage reservoirs 72.

The photoconductor can preferably be designed in the form of a roller or as a continuous belt. An amorphous silicon can thereby be used as a photoconductor material or an organic photoconductor material (also designated as an OPC).

Instead of a photoconductor, other image carriers (such as magnetic, ionizable etc. image carriers) can also be used that do not operate according to the photoelectric principle, but rather which will electrically, magnetically or otherwise impress latent images according to other principles, which images are then inked and ultimately transferred to the recording medium 20.

LED lines or even lasers with corresponding scan mechanism can be used as a character generator 109.

The transfer element can likewise be designed as a roller or as a continuous belt. The transfer element can also be omitted. The print image 20' is then directly transferred from the photoconductor roller 101 to the recording medium 20.

What is to be understood by the term "electrophoresis" is the migration of the charged toner particles in the carrier fluid as a result of the action of an electrical field. At each transfer of toner particles, the corresponding toner particles essentially completely pass to a different element. After contacting the two elements, the fluid film is approximately split in half as a result of the wetting of the participating elements, such that approximately one half remains adhered to the first element and the remaining part remains adhered to the other element. The print image 20' is transferred and then transported further in the next part in order to allow an electrophoretic migration of the toner particles again in the next transfer region.

The digital printer 10 can have one or more print groups for the front side printing and (if applicable) one or more print groups for the back side printing. The print groups can be arranged in a line, L-shaped or U-shaped.

Instead of the take-up stand 27, post-processing devices (not shown) can also be arranged after the feed group 26, such as cutters, folders, stackers etc. in order to bring the recording medium 20 into the final form. For example, the recording medium 20 could be processed so far that a finished book is created at the end. The post-processing apparatuses can likewise be arranged in series or curved away from this.

As was previously described as a preferred exemplary embodiment, the digital printer 10 can be operated as a roll-to-roll printer. It is also possible to cut the recording medium 20 into sheets at the end and to subsequently stack the sheets, or to further process them in a suitable manner (roll-to-sheet printer). It is likewise possible to feed a sheet-shaped recording medium 20 to the digital printer 10, and to stack the sheets or process them further at the end (sheet-to-sheet printer).

If only the front side of the recording medium 20 is printed, at least one print group 11 with one color is thus required (simplex printing). If the back side is also printed, at least one print group 12 is also required for the back side (duplex printing). Depending on the desired print image 20' on the front side and back side, the printer configuration includes a corresponding number of print groups for front side and back side, wherein every print group 11, 12 is always designed for only one color or one type of toner.

The maximum number of print groups 11, 12 is only technically dependent on the maximum mechanism draw load of the recording medium 20 and the free feed length. Arbitrary configurations are typically possible, from a 1/0 configuration (only one print group for the front side to be printed) to a 6/6 configuration in which six print groups can respectively be present for the front side and back side of the recording medium 20. The preferred embodiment (configuration) is shown in FIG. 1 (a 4/4 configuration), with which full-color printing with the four primary colors is produced for the front side and back side. The order of the print groups 11, 12 in four-color printing advantageously proceeds from a print group 11, 12 that prints in light color (yellow) to a print group 11, 12 that prints in dark color, thus for example that prints the recording medium 20 in the color order Y-C-M-K from light to dark.

The recording medium 20 can be produced from paper, metal, plastic or other suitable and printable materials.

Figure 3:
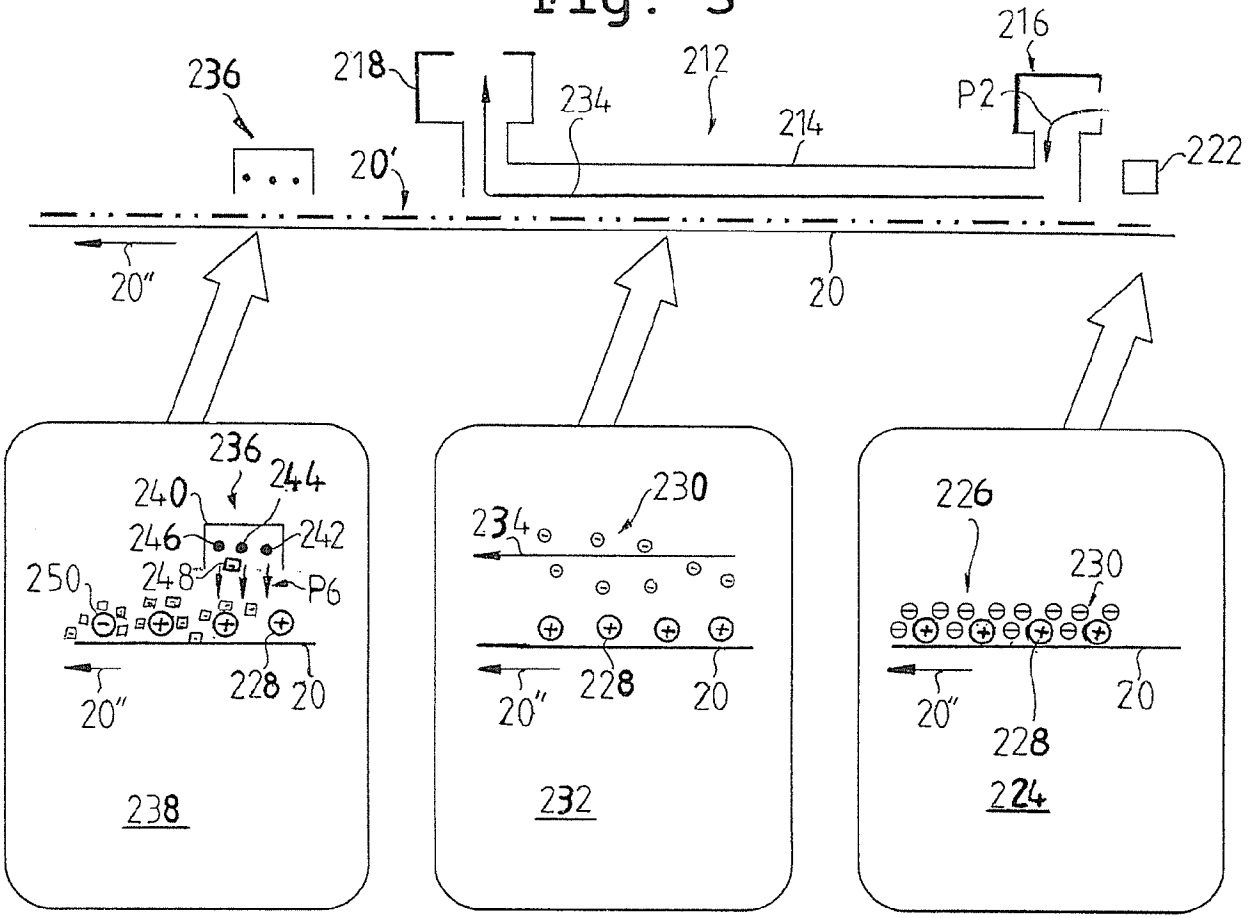
FIG. 3 is a schematic workflow of a conditioning of a recording medium.

FIG. 3 shows a schematic workflow of a conditioning of the recording medium 20 according to an exemplary embodiment which is directed along a drying route 212 in the transport direction 20". The drying route 212 is bounded by the recording medium 20, a boundary 214 situated opposite the recording medium 20, an air feed 216 and an air discharge 218. In the exemplary embodiment, the air feed 216 comprises a blower with which a predetermined air flow 234 can be introduced into the drying route 212 in the direction of the arrow P2. The air feed 216 furthermore comprises a heating element (not shown) to heat the air flow 234 and a humidifier element (not shown) to adjust a predetermined relative humidity.

A toner image 20' that has already been applied on the top side of the recording medium 20 in the print group 11 is first directed past an optical sensor 222. An image section 224 schematically shows the surface of the recording medium 20 with the unfixed toner image 20' before reaching the drying route 212, for example at an optical sensor 222. A layer of liquid developer 226 comprises positively charged toner particles (of which one is designated with the reference character 228) that are embedded in the carrier fluid 230. This liquid developer 226 is located at the points of the recording medium 20 that are inked with the toner image 20'. The recording medium 20 is transported in the transport direction 20".

The positive charge of the toner particles 228 arises in interaction with the charge control substance that was added to the carrier fluid 230 before the printing process. The charge control substance dissolved into the carrier fluid simultaneously adopts a negative charge in this process so that the liquid developer 226 remains electrically neutral to the outside.

The optical sensor 222 detects what proportion of the side of the recording medium 20 is covered with the toner image 20'. From these data, together with the data of a transport speed of the recording medium 20 and the type of recording medium 20, a control unit (not shown) determines the parameters to be adjusted for air temperature and air flow 234. An additional sensor (not shown) detects the relative humidity of the recording medium 20 before application of the toner image 20'. The air feed 216 is controlled such that the air flow 234 along the drying route 212 has a relative humidity corresponding to the relative moisture of the recording medium 20 that was measured before the application of the toner image 20'. Given paper, typical values for the relative moisture of the recording medium 20 are 40% to 50% dependent on the paper type, respectively measured at 20° C. Moreover, the temperature and the volume flow of the air flow 234 is adjusted in the air feed 216 and introduced into the drying route 212 in the direction of the arrow P2. The temperature of the air for the air flow 234 lies in the range from 40° C. to 50° C.

An image section 232 schematically shows the surface of the recording medium 20 with the toner image 20' in the drying route 212. The volatile portions of the liquid developer 226—essentially carrier fluid 230—evaporate in part and are discharged with the air flow 234. The positively charged toner particles 228 and a residue of carrier fluid 230 remain on the recording medium 20. The drying parameters are adjusted such that the remaining residue of carrier fluid 230 is small, and the remaining electrophoretic mobility of the toner particles 228 is reduced so that they do not migrate in the influence of an electrical field, and the quality of the toner image is maintained. The air flow 234 with the evaporated portions of the carrier fluid 230 is drawn off in the air discharge 218.

The air flow 234 and the transport direction 20" for the recording medium 20 are directed identically in FIG. 3. It can be advantageous when the air flow 234 travels in the opposite direction, since a stronger turbulence of the air hereby takes place which abets the drying.

After the drying route 212, the recording medium 20 is directed past a corotron 236, wherein the side with the toner image 20' is facing towards the corotron 236. An image section 238 schematically shows the surface of the recording medium 20 with the dried toner image 20' at the corotron 236. The corotron 236 comprises a shield 240 as a first electrode and a wire as a second electrode, here three wires 242, 244, 246. A potential of approximately −6 kV (−6000 volts) is applied to the wires 242, 246, and a potential of approximately −2 kV is respectively applied against ground. Air molecules are ionized by the corotron 236, and the negatively charged ions formed in such a manner (of which one is designated with the reference character 248 as an example) are accelerated in the direction of the recording medium 20, as this is indicated by the arrow group P6. The positively charged ions likewise formed in the corotron 236 do not leave the corotron 236, but rather are neutralized again in the wires 242 through 246 and at the shield 240. Given use of negatively charged toner particles, the indicated voltage values have reversed algebraic sign.

The electrical potentials at the corotron 236 are selected so that a majority of the negative ions 238 formed in the corotron 236 negotiate the air route to the toner particles 228. The different charges thereby come into contact and are neutralized. In this exemplary embodiment, the positive charge of the toner particles 228 is even overcompensated, as this is shown at the uncharged (and therefore negatively charged) toner particles 250. If a single corotron 236 is not sufficient to recharge the toner particles, in other embodiments of the invention multiple corotrons 236 are used in parallel.

The corotron 236 comprises at least one thin wire 242 through 246 made from an electrically conductive material with high melting point (tungsten, for example), as well as an electrically conductive shield 240. With an electrical potential difference of approximately 3 kV (3000 volts) between the respective wire 242 through 246 and shield 240, electrical field strengths arise at the wires 242 through 246 that are so high that the surrounding air is ionized and a corona discharge occurs. A higher potential difference between the respective wire 242 through 246 and shield 240 leads to a current flow between the respective wire 242 to 246 and shield 240. The maximum adjustable potential difference in the corotron 236 is provided by an electrical breakdown resistance of the air, which is approximately 3 kV/mm, and given a smallest clearance between the respective wire 242 to 246 and shield 240.

The charge of the ions 248 generated in the corotron 236 is adjusted via the potentials of the wires 242 to 246 and shield 240, respectively measured against ground. If negatively charged ions 246 should be generated, in tests it has proven to be suitable to set a potential of approximately −6 kV at the wires 242 to 246 and a potential of −2 kV at the shield 240.

Figure 4:
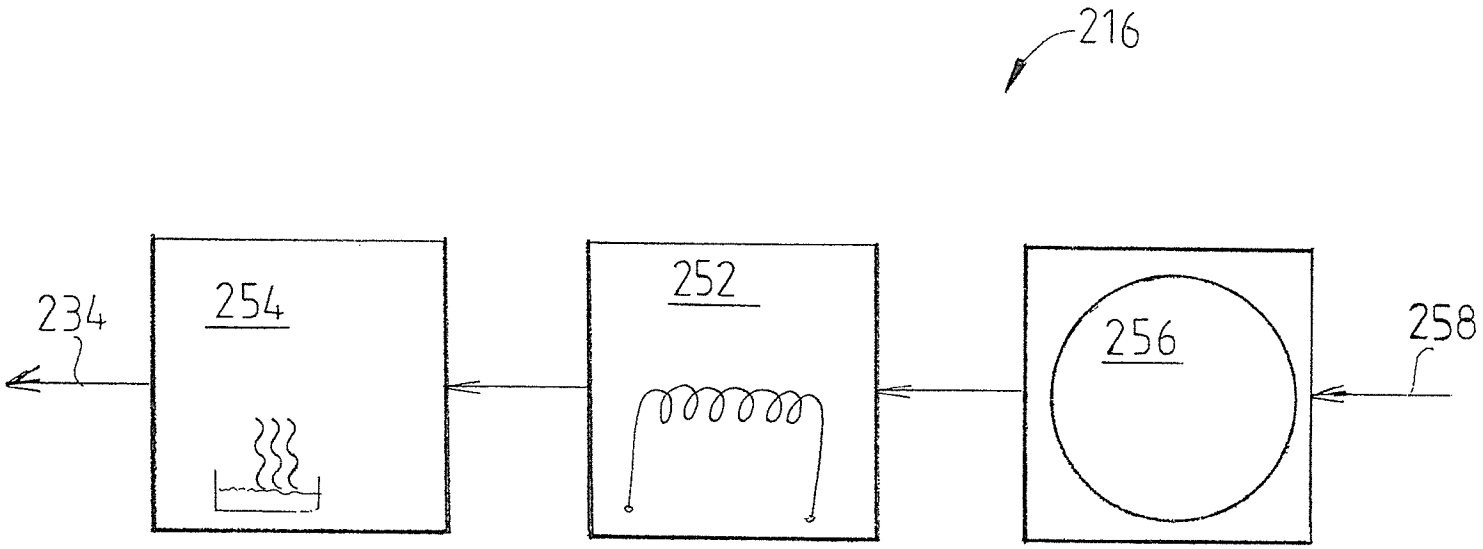
FIG. 4 is a block diagram for the air feed.

FIG. 4 shows a block diagram for air feed 216. Outside air 258 is drawn in by a blower 256 and is directed further as an air flow 234. The air flow 234 arrives from the blower 256 at a heating device 252.

The heating device 252 brings the air flow 234 to a preset temperature via heating, advantageously to approximately 40° C. to 50° C. The heating device 252 comprises one or more heating wires for this. Alternatively or additionally, other elements can also be provided that transduce electrical energy into heat.

After the heating device 252, the air flow 234 streams through a humidifier 254. For example, the humidifier 254 increases the relative humidity in the air flow 234 corresponding to an adjustable value, for example via ultrasound atomization of water or the like. This value of the relative humidity is dependent on the recording medium 20 and is selected such that the air flow 234 adjusts the relative moisture of the as of yet unprinted second side of the recording medium 20 so that this essentially coincides with the relative moisture of the first side of the recording medium 20 before the application of the first toner image 20'. For example, if paper is used as a recording medium 20, depending on the paper type this has a relative moisture of approximately 40% to 50% (measured at 20° C.) before the printing.

In other embodiments of the humidifier 254, the air flow 234 is humidified with other methods, for example vaporization or evaporation of water, as well as via atomization by means of pumps and fine nozzles.

The described method and the digital printer use a web-shaped recording medium. At least one print group is hereby required to apply the first toner image, and after the turning of the recording medium at least one second print group is required that applies the second toner image on the second side. However, the embodiments can also be executed with a single print group, wherein this print group prints to both sides. In particular, this can be advantageous for single sheet printing, wherein the single sheet is supplied once directly and the other time turned over to the same print group.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to operate a digital printer for double-side printing to a recording medium with toner particles that are applied with aid of a liquid developer, comprising the steps of:

providing the digital printer with at least one print group and printing first and second sides of the recording medium in succession;

providing the liquid developer with toner particles, carrier fluid, and a charge control substance;

reducing electrophoretic mobility of toner particles of a first toner image on the first side after application of said first toner image on the first side of the recording medium and before application of a second toner image on the second side of the recording medium, said electrophoretic mobility being reduced by drying the first toner image along a drying route in an air flow generated by a blower such that carrier fluid is thus removed from the first toner image but without fixing the first toner image to the recording medium, the air flow being heated by a heating device to a predetermined temperature; and after the application of the second toner image on the second side of the recording medium, both the first and the second toner images are simultaneously fixed, wherein the toner particles are fused and permanently bonded with the recording medium.

2. The method according to claim 1 wherein the predetermined temperature lies in a range from 40° C. to 50° C.

3. The method according to claim 1 wherein to reduce the electrophoretic mobility the first side is charged with ions that have an electrical charge which has a polarity opposite an electrical charge of the toner particles.

4. The method according to claim 3 wherein the first side is charged with ions such that a polarity of an electrical charge of at least some of the toner particles changes.

5. The method according to claim 3 wherein the ions are generated by means of a corona discharge.

6. The method according to claim 3 wherein the drying is implemented before the charging of the first side with ions.

7. A method to operate a digital printer for double-side printing to a recording medium with toner particles that are applied with aid of a liquid developer, comprising the steps of:

providing the digital printer with at least one print group and printing first and second sides of the recording medium in succession;

providing the liquid developer with toner particles, carrier fluid, and a charge control substance;

reducing electrophoretic mobility of toner particles of a first toner image on the first side after application of said first toner image on the first side of the recording medium and before application of a second toner image on the second side of the recording medium, said electrophoretic mobility being reduced by drying the first toner image along a drying route in an air flow generated by a blower such that carrier fluid is thus removed from the first toner image, the air flow being heated by a heating device to a predetermined temperature;

moistening the first toner image on the first side by a humidifier to reduce electrophoretic mobility; and after the application of the second toner image on the second side of the recording medium, both the first and the second toner images are simultaneously fixed, wherein the toner particles are fused and permanently bonded with the recording medium.

8. The method according to claim 7 wherein the humidifier adjusts a relative humidity of the air flow such that relative moisture of the second side of the recording medium substantially coincides with relative moisture of the recording medium before printing of the first side.

9. The method according to claim 8 wherein a value of the relative moisture of the recording medium is determined by means of a sensor before application of the toner image on the first side, and the relative humidity of the air o adjusted depending on said value.

10. A digital printer for double-sided printing of a recording medium with toner particles that can be applied with aid of a liquid developer, comprising:

at least one print group which prints both first and second sides of the recording medium in succession;

the liquid developer comprising toner particles, carrier fluid, and a charge control substance;

a drying unit via which electrophoretic mobility of toner particles of a first toner image on the first side is reduced after application of a said first toner image on the first side of the recording medium and before application of a second toner image on the second side of the recording medium, said drying unit reducing the electrophoretic mobility by drying the first toner image along a drying route in an air flow generated by a blower to remove carrier fluid from the first toner image without fixing the first toner image to the recording medium, a heating device being provided which heats the air flow to a predetermined temperature; and a fixing device which fixes the first and second toner images after application of the second toner image on the second side of the recording medium, so that the toner particles are fused and permanently bonded with the recording medium.

11. The device of claim 10 wherein said predetermined temperature is in a range from 40° C. to 50° C.

12. The device of claim 10 wherein to reduce the electrophoretic mobility the first side is charged with ions that have an electrical charge which has a polarity opposite an electrical charge at the toner particles.

13. The device of claim 12 wherein the first side is charged with ions such that a polarity of an electrical charge of at least some of the toner particles changes.

14. A method to operate a digital printer for double-side printing to a recording medium with toner particles that are applied with aid of a liquid developer, comprising the steps of:

printing first and second sides of the recording medium in succession;

providing the liquid developer with toner particles, carrier fluid, and a charge control substance;

reducing electrophoretic mobility of toner particles of a first toner image on the first side after application of said first toner image on the first side of the recording medium and before application of a second toner image on the second side of the recording medium, said electrophoretic mobility being reduced by drying the first toner image along a drying route in an air flow generated by a blower such that carrier fluid is thus removed from the first toner image but without fixing the first toner image to the recording medium; and after the application of the second toner image on the second side of the recording medium, both the first and the second toner images are fixed, wherein the toner particles are fused and bonded with the recording medium.

15. A digital printer for double-sided printing of a recording medium with toner particles that can be applied with aid of a liquid developer, comprising:

at least one print group which prints both first and second sides of the recording medium in succession;

the liquid developer comprising toner particles, carrier fluid, and a charge control substance;

a drying unit via which electrophoretic mobility of toner particles of a first toner image on the first side is reduced after application of a said first toner image on the first side of the recording medium and before application of a second toner image on the second side of the recording medium, said drying unit reducing the electrophoretic mobility by drying the first toner image along a drying route in an air flow generated by a blower to remove carrier fluid from the first toner image but without fixing the first toner image to the recording medium; and a fixing device which fixes the first and second toner images after application of the second toner image on the second side of the recording medium, such that the toner particles are fused and bonded with the recording medium.

* * * * *